United States Patent [19]

McKneelan

[11] Patent Number: 4,486,909

[45] Date of Patent: Dec. 11, 1984

[54] MEANS FOR ANCHORING SHEET TO WATERBED

[76] Inventor: Robert L. McKneelan, 774 Bayou Liberty Rd., #6F, Slidell, La. 74058

[21] Appl. No.: 155,108

[22] Filed: Jun. 2, 1980

[51] Int. Cl.[3] ..... A47C 27/08; A47G 9/00

[52] U.S. Cl. ..... 5/451; 24/72.5

[58] Field of Search ..... 5/451, 452, 402, 488, 5/496, 498; 24/72.5

[56] References Cited

U.S. PATENT DOCUMENTS

| | | | |
|---|---|---|---|
| 664,855 | 1/1901 | Harris | 24/72.5 |
| 4,040,133 | 8/1977 | Gilreath | 24/72.5 |
| 4,222,139 | 9/1980 | Svedberg-Reker et al. | 5/402 |

*Primary Examiner*—Alexander Grosz

[57] ABSTRACT

In a waterbed including a frame and a fluid-containing mattress positioned within said frame, means for anchoring a covering, e.g., a flexible sheet, pad, combinations of same, and the like, over the top of said mattress, said anchoring means including a plurality of resilient strap elements attached at one end of each thereof to the inside and in spaced relationship to each other about the inside periphery of said frame, and for each of said strap elements a removeable connection element having means located on one end thereof adapted to connect same to said strap element and having means located on the other end thereof adapted to releaseably connect same in a button hole provided in said bed covering desired to be anchored. Such connection elements, for example, may each consist of a pair of buttons loosely attached together with resilient thread, so that one button thereof is connected to a strap element through a button hole in the latter and the other button thereof is employed to hold down the covering through a corresponding positioned button hole in said covering.

1 Claim, 4 Drawing Figures

MEANS FOR ANCHORING SHEET TO WATERBED

BACKGROUND OF THE INVENTION

This invention relates to means for anchoring a flexible covering, such as a sheet, pad, and/or combinations of the same, to the surface of a waterbed.

The type of bed consisting of a fluid-containing mattress mounted in a frame, commonly referred to as a "waterbed", has gained relative widespread publicity in recent years, primarily due to a claimed increased comfort characteristic as compared to conventional beds. Such waterbeds, however, have failed to achieve the predicted general acceptance and usage because of several drawbacks of same inherent in their design. Two of such drawbacks have been particularly bothersome: (a) an inability to suitably anchor a covering, such as a sheet or pad, over the top of the fluid-containing mattress, and (b) a tendancy of the fluid-bearing mattress to occasionally leak.

To remedy the leakage problem, it has been suggested and now apparently generally adopted in waterbed designs to locate and provide an impervious liner in the bottom of the bed frame beneath the fluid-confining mattress. While the utilization of such a supplemental liner has solved the leakage problem, excepting in cases of total mattress failure, since such liners usually are formed of smooth-surfaced plastic films, the use of such liners have served to further aggravate the problem of mattress cover movement due to an inability of a waterbed conventional design to submit to attempts to "tuck" the edges of a sheet or pad covering under the mattress as do conventional mattresses. Hence, it remains common to waterbeds, particularly those having plastic liners, that coverings, such as sheets and pads, fail to remain satisfactorily in place due to the edges slipping out from between the frame and mattress of such beds.

Various techniques, including those disclosed in U.S. Pat. Nos. 2,024,050; 3,011,182; 3,179,958; and 4,040,133 have been proposed to assist in anchoring a covering such as a sheet to a mattress, but have not been totally suitable for use with waterbeds due to problems in adapting the same to fluid-containing mattresses, difficulties in installing same to existing beds in which the mattress is already filled with fluid, and/or requiring the utilization of expensive and/or inconvenient modifications to the bed covers, e.g., sheets.

Accordingly, a search has continued in the art for suitable and versatile means for anchoring coverings, such as sheets and pads, to the surface of waterbeds.

OBJECTS OF THE PRESENT INVENTION

Accordingly, it is the primary object of the present invention to provide an improved means for anchoring a cover sheet to the surface of a waterbed.

Another object of the present invention is to provide a simple and inexpensive means which is adapted to efficiently anchor a cover sheet to the top of a waterbed.

An additional object of the present invention is to provide an improved means for anchoring a cover sheet to the surface of a waterbed, which means advantageously is adapted to anchor satisfactorily a flexible sheet, pad, and even combinations of same.

A further object of the present invention is to provide an improved means for anchoring sheet materials to the surface of waterbeds, which means is advantageously adapted to satisfactorily achieve the desired anchoring even with waterbeds having leak-proof supplemental bottom liners.

Still another object of the present invention is to provide an improved means for anchoring sheet material to the surface of waterbeds, which means advantageously is adapted to be installed easily to such beds in which the fluid-bearing mattress is already filled.

Yet an additional object of the present invention is to provide an improved means for anchoring sheet material to the top of a waterbed, which means does not require expensive or inconvenient modifications of such sheet material.

Another object of the present invention is to provide an improved means for anchoring one or more sheet materials to the surface of a waterbed, which means is adjustable and variable in use to advantageously be adapted for use with varying sized sheet materials.

DESCRIPTION OF DRAWINGS

The above and other objects are achieved and are features of the waterbed sheet anchoring means of the present invention which is described hereinbelow in detail with particular reference being made to the accompanying drawings of which.

DESCRIPTION OF SPECIFIC EMBODIMENTS

Figure 1:
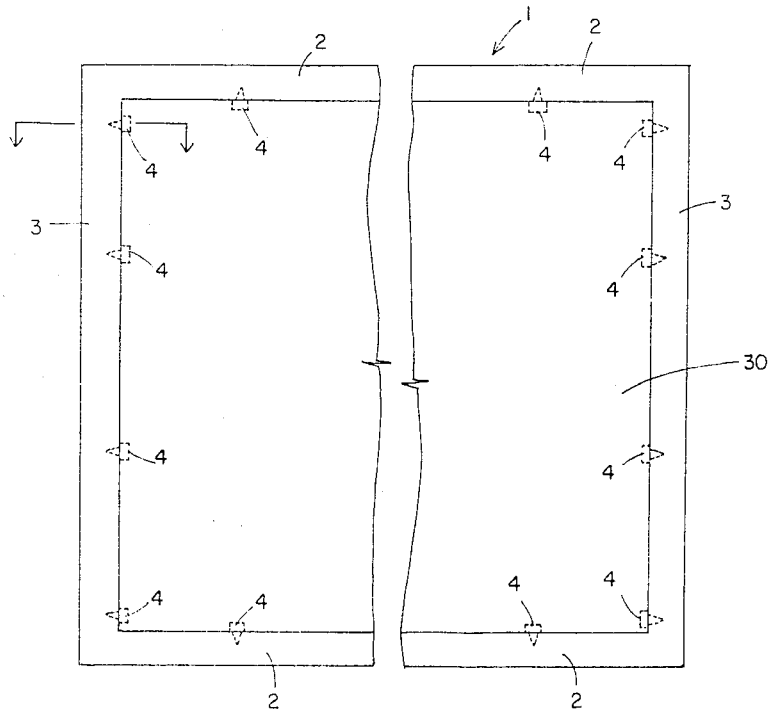
FIG. 1 is a top diagrammatic view of a waterbed having a top sheet anchored thereon by the means of the present invention.
Figure 2:
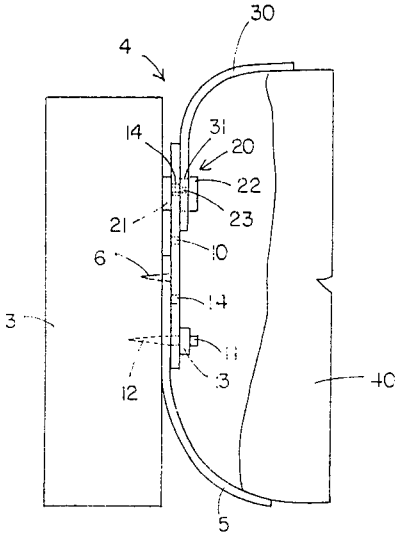
FIG. 2 is a sectional view, partially broken away, of the waterbed of FIG. 1 taken at the depicted line with two arrows in the upper left side corner of FIG. 1, showing the anchoring means of the present invention.
Figure 3:
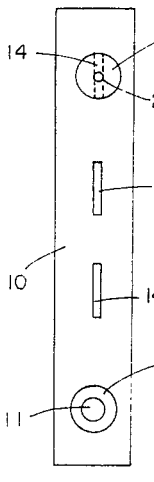
FIG. 3 is an expanded front view of an embodiment of the anchoring means of the present invention.
Figure 4:
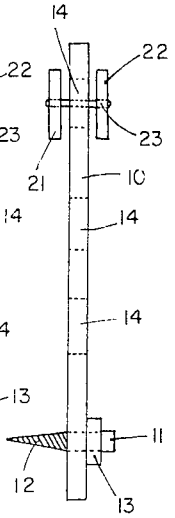
FIG. 4 is a side view of the anchoring means embodiment shown in FIG. 3.

With particular reference to FIGS. 1 and 2 numeral 1 generally designates the frame of a waterbed having end members 2 and side members 3, in which frame 1 a fluid-containing mattress 40 is positioned and located above a liner element 5 attached to the inside of frame 1 by suitable connectors, such as staples 6. In accordance with the present invention, a cover sheet 30 is positioned on the surface (top) of mattress 40 and retained in place by a plurality of sheet-retaining means 4 attached to the inside periphery of frame 1 in spaced relationship with respect to each other.

In accordance with the present invention, the anchoring means thereof comprises a plurality of such means 4, each including a strap element 10 formed of a resilient material, such as an elastomer and the like, and a suitable connection means, such as a screw element 11 having a threaded end 12, whereby strap element 10 is attached removeably or permanently to the inside periphery of frame 1. More preferably, in cases wherein connector 11 is caused to pierce liner 5 in the desired attachment of means 4 to frame 1, a resilient washer element 13 is provided around the head of connector 11 to maintain the leak-proof integrity of liner 5.

In further accordance with the present invention, such plurality of sheet-retaining means 4 each is provided with a removable connection element designated generally numeral 20 which functions to releaseably fasten a strap 10 to cover sheet 30 in the region of sheet 30 corresponding to the location of that particular strap 10, with a sufficient number of such means 4 being spaced around the inside periphery of frame 1 so that when the straps 10 thereof are connected by the connection elements 20 thereof to sheet 30 in the respective corresponding adjacent locations of sheet 30 sheet 30 is maintained in place covering the desired areas of the upper surface of mattress 40.

To simplify any required modification of sheet 30 to be adapted for use with the anchoring means of the present invention, sheet 30 is provided with a button hole 31 positioned adjacent each of retaining means 4. Each connection element 20 of each means 4 has located on one end thereof a button element 22 which allows each connection element 20 to be attached by such button 22 to sheet 30 by means of an engagement of button 22 with its correspondingly adjacently located and cooperatingly sized button hole 31 in sheet 30. By means thereby, connection elements 20 simply and easily may be attached to sheet 30 without the need for expensive or inconvenient modifications of sheet 30. Similarly, by the utilization of button element 22 as the connection expedient of means 4 to sheet 30, more than one sheet member 30, e.g., a base pad and a convering sheet, both may be suitably placed and maintained on the surface of mattress 40 by the present invention, if such is desired.

In accordance with the present invention, each connection element 20 of each means 4 has at the end thereof removed from button 22 a suitable connection member, e.g., button element 21, which is adapted to releaseably attach connection element 20 to a strap element 10, by a cooperating engagement between element 21 and such strap 10, e.g., by strap 10 being provided with a cooperatingly sized button hole 14. In the preferred embodiments of the present invention, a strap element 10 is provided with a plurality of elements, e.g., button holes 14, spaced along its length to adapt strap members 10 to be utilized to anchor sheets 30 of varying sizes and dimensions without a need to modify means 4 or to remove and replace same, including cases wherein a single pad or sheet is to be anchored alone or combinations thereof of the same or different dimensions are to be attached.

In the more preferred embodiments of the present invention, each connection element 20 of each means 4 itself is resilient, by making the connection element from a thread. This latter embodiment adds strength to the already resilient characteristic of means 4, due to strap 10 being resilient, to advantageously allow sheet 30 to be compactly fastened to mattress 40, but still allow sheet 30 to move and give as mattress 40 undulates in its characteristic manner.

While the connection between element 20 and strap 10 is shown only through button 21 and button holes 14, it will be understood that, in accordance with the present invention, any suitable conventional combination of cooperating connection elements also suitably may be used, such as providing connection 14,21 in the form of cooperating hook-slot or slot-hook combinations, cooperating patches of hook and loop-type fastners, such as the ones sold under the trademark of "Velcro" brand fabric, and the like, so long as connection 22,31 is retained as a button-button hole combination to maintain the releaseability and multiple sheet-anchoring capability of means 4.

What is claimed is:

1. In a waterbed including a frame and a fluid-containing mattress positioned within said frame, the improvement comprising means for anchoring a flexibile covering over the top surface of said mattress, said anchoring means comprising a plurality of spaced, resilient strap elements attached by one end of each thereof to the inside and about the inside periphery of said frame, and for each of said strap elements a removeable connection element, each of said connection elements having a first button means located on one end thereof adapted to releaseably attach same to said strap element, in a button hole provided in the end of said strap element removed from said frame, and having a second button means located on the other end thereof adapted to releaseably attach same in a button hole provided in said bed cover, said first and second button means being interconnected by a rigid element, said anchoring means and said button holes in said strap elements and said bed cover being correspondingly and cooperatively located so that said cover is maintained in the desired position on the surface of the mattress.

* * * * *

UNITED STATES PATENT AND TRADEMARK OFFICE

CERTIFICATE OF CORRECTION

PATENT NO. : 4,486,909

DATED : December 11, 1984

INVENTOR(S) : Robert L. McKneelen

It is certified that error appears in the above-identified patent and that said Letters Patent is hereby corrected as shown below:

On the title page, inventor's name should read

-- Robert L. McKneelen --.

Signed and Sealed this

*Fifth* Day of *March 1985*

[SEAL]

*Attest:*

DONALD J. QUIGG

*Attesting Officer* *Acting Commissioner of Patents and Trademarks*